US006764331B2

(12) United States Patent
Sloan

(10) Patent No.: US 6,764,331 B2
(45) Date of Patent: Jul. 20, 2004

(54) SMALL-SIZED CONNECTOR

(75) Inventor: Davin Sloan, Annapolis, MD (US)

(73) Assignee: Textron Micro Electronics Incorporated, Hanover, MD (US)

( * ) Notice: Subject to any disclaimer, the term of this patent is extended or adjusted under 35 U.S.C. 154(b) by 0 days.

(21) Appl. No.: 10/142,796

(22) Filed: May 13, 2002

(65) Prior Publication Data

US 2003/0211771 A1 Nov. 13, 2003

(51) Int. Cl.[7] ..... H01R 13/627
(52) U.S. Cl. ..... 439/352; 439/903
(58) Field of Search ..... 439/352, 353, 439/350, 354, 357, 607, 801, 727, 592, 903, 737, 598, 589, 901

(56) References Cited

U.S. PATENT DOCUMENTS 2,410,618 A * 10/1946 Zelov ..... 439/901
3,721,939 A * 3/1973 Paugh ..... 439/354
5,295,855 A * 3/1994 Walz ..... 439/357
5,356,304 A * 10/1994 Colleran ..... 439/358
6,162,093 A * 12/2000 Sudol et al. ..... 439/607
6,508,660 B2 * 1/2003 Self ..... 439/607
6,561,699 B1 * 5/2003 De Marchi ..... 439/353

OTHER PUBLICATIONS

29 Connector & Interconnection Symposium & Trade Show Highlights and Call for Coverage, Jan. 7, 2000, <http://www.pcisig.com/reflector/msg00044.html>.

(List continued on next page.)

*Primary Examiner*—Renee Luebke
*Assistant Examiner*—Felix O. Figueroa
(74) *Attorney, Agent, or Firm*—Foley & Lardner

(57) ABSTRACT

A small sized connector for connecting wires to an electrical component, such as a printed circuit board. The connector includes a connector frame, and a latch that is hingedly connected to the connector frame. The latch has a raised portion at one end thereof, whereby, when the connector frame is fitted within an opening of a housing that holds the printed circuit board, the latch is pressed downwards to be fitted within the opening, and then the raised portion of the latch pops into a slot of the housing to thereby lock the connector in place within the housing. The connector can be easily de-coupled from the housing by a user pressing his or her fingertip against the raised portion of the latch, while pulling the connector out of the opening at the same time.

13 Claims, 20 Drawing Sheets

OTHER PUBLICATIONS

Alden Products Company (North American Suppliers Directory), Aug. 14, 2000, http://www.devicelink.com/company98/a/a00081.html.

Diablo Sales & Marketing Inc. (North American Suppliers Directory), Aug. 14, 2000, http://www.devicelink.com/company98/d/d00227.html.

ExporTec LLC (North American Suppliers Director), Aug. 14, 2000, http://www.devicelink.com/company98/e/e00140.html.

Tronomed Inc. (North American Suppliers Director), Aug. 14, 2000, http://www.devicelink.com/company98/t/t00208html.

InterCon Systems—Sales and Tech Support, Dec. 3, 1999, http://www.interconsystems.com/home/sales.

Printable Service Page, Connectors Unlimited, Jan. 11, 2000, http://www.conunltd.com/printabl.htm.

MDL:Medical Design & Manufacturing . . . 2000 Medical Electronics Pavillon, Dec. 10, 1999, http://www.devicelink.com/expo/west00/p–medelec.html.

Medical Electronics Advertiser Index, Jun. 1999, Dec. 2, 1999, http://www.mac–med.com/MED%20FILES/6medad-index.html.

2000 International Institute of Connector and Interconnection Technology, Inc. Seminar, Registration Form, (2 pages).

NANONICS, "Leading the Way in Nanominiature Connector Technology" (1 page), Letter to Frank Mataitis, Jun. 3, 1997, re: New Generation, 0.25/.0125 pitch, Nanominature connectors, (1 page), NANONICS Connectors, Features & Benefits (1 page), NANONICS Corporation, Editorial, "Electronic Packaging and Production" (2 pages), NANONICS Corporation, New Generation, 0.25/.0125 pitch, Nanominature Connectors, (2 pages), NANONICS' Nanominiature Qualification Test Summary (1) MIL–C–83513 & DSCC 94031 (2) Qualification Tests NANONICS' Dualobe®, 51 Pin Metal Shell Electrical Connectors (1 page), Schematic of the Nanonics Plug, Single Row Dualobe® Plaster or Metal (1 pages) NANONICS Single Row Dualone®, Scoop–proof, Plastic or Metal Shrouded Connectors Cryogenic (–200° C) to 225° C (2 pages) and NANONICS Single Row Unshrouded "Strip" Connectors; Plastic Insulators Cryogenic (–200° C) to 225° C (2 pages).

Omnetics Connector Corporation– Series nano (2 pages), Omnectics Connector Corporation—MicroLatch (2 pages), Omnectics Connector Corporation Article re their Facility (1 pages).

Molex Ulti–Mate, Inc., "Microminiature and Nanominiature Connectors & Value Added Assemblies", Molex Industrial Division, (5 pages).

Connection/Interconnection Products—Technology Updates—Industry News, Feb. 2000, www.csmag.com (2 pages).

* cited by examiner

SMALL-SIZED CONNECTOR

BACKGROUND OF THE INVENTION

A. Field of the Invention

The invention relates generally to a small-sized electrical connector, and, more particularly, to separable interconnection of electronic components that use electrical wires and/or cables.

B. Description of the Related Art

For electronic devices that are small in size, the corresponding printed circuit boards and components housed within those devices are also necessarily small in size. Accordingly, electrical connectors that connect wires between small sized electronic components have to be small in size.

For example, a radio transmitter device, sending audio intelligence gained from a microphone to a remotely located receiver, as commonly used in clandestine operations by undercover police officers, has to be as small as possible in size so that the person carrying the device is not detected as being an undercover police officer. In many cases there are several components comprising such a device. For example, a typical system might include a battery, one or more microphones, an antenna, a transmitter unit, and possibly a remote activation switch. The transmitter is usually considered the central component in such a system. Often, it is necessary for the components of such a system to be placed in several locations on the undercover police officer (e.g., taped to his or her arm, leg or abdomen and covered by, or contained within his or her clothing). Because the components are separated, a reliable means of electrical interconnection becomes necessary. In addition to the components being interconnected, a means of quickly and easily disconnecting and reconnecting the individual components is also necessary. This allows, for example, components sewn into clothing to be connected with components attached to the user's body. The interconnection of each component is via one or more wires. Most often these wires are electrically shielded to prevent interference from external signals or to prevent escape of signals carried within the wire or cable, thereby preventing interference with other devices, or between cables.

As technological advances have allowed the components of such a system to be made much smaller, connectors that were once appropriately sized are now too large. A smaller connector that retains the important features of the larger connector is needed. The primary requirements for such a connector are Nano size, positive locking capability, easy tool free insertion and removal, full electrical shielding, and non-interchangeability.

Connectors are often grouped by size according to distance, or pitch between each individual pin or connection. Connectors with a pitch of 0.025 inches or similar pitch are commonly referred to as "Nano" or "Nanominiature" connectors. Several companies manufacture connectors that would be considered Nano Connectors. None of these companies offers a product that meets all of the requirements (other than size) at once, that the larger connector met. Since the size of these connectors is necessarily very small, meeting all of the requirements at once is difficult.

Firstly, there is a problem in providing a high strength positive coupling of the Nano Connector to the mating receptacle. If a connection is not sufficiently secured, it may become inadvertently disconnected, causing loss of signal and endangering the lives of the undercover persons. Currently available Nano Connectors either are not positive locking or if positive locking, have mechanisms that are difficult to connect and disconnect quickly and easily. Some Nano Connectors use small jackscrews at each end to couple the connector to its mating receptacle. The small size of the connector and jackscrews makes it difficult to connect and disconnect. Furthermore, there is a need for a tool, such as a small screwdriver, in order to couple and de-couple the connector. Nearby wires are vulnerable to damage from the screwdriver tip. Also, the jackscrews substantially increase the size of the connector. Other latching mechanisms also add substantially to the overall size of the connector. Some mechanisms are exposed and vulnerable to damage while disconnected. If a mechanism requires a separable part, it could be easily lost.

Secondly, few Nano Connectors are designed to provide a means of electrically shielding the connection. Complete electrical shielding across a connection occurs when the shield conductor of the electrical cable makes a direct connection to a conductive enclosure that surrounds the entire connection and makes electrical contact with the corresponding enclosure surrounding the receptacle.

Thirdly, a means of providing non-interchangeability between one size or type of connector and another, or for preventing backwards or otherwise improper mating of a connector, is not available in conjunction with the other aforementioned features.

SUMMARY OF THE INVENTION

One aspect of the invention relates to a Nanominiature electrical interconnect system. The system is comprised of plugs and receptacles of various constructions and sizes, but with common design attributes. This system allows for convenient, tool free interconnections, and simplified manufacturing and assembly.

According to a first aspect of the invention, there is provided a connector plug, which includes an outer body. The connector plug also includes a latch that is disposed on a top portion of the outer body, in which the latch has a raised catch at one end of its top surface. The connector plug further includes a pin for hingedly coupling one end of the latch within a slot on the top portion of the outer body. The connector plug further includes an elastomeric material, which acts as a spring, providing an outward pressure against the latch. The connector plug further includes a pin contact assembly, contained within the plug body, with an attached cable extending from the rear of the connector body.

According to a second aspect of the invention, there is provided an inline connector receptacle, which includes an outer body. The connector receptacle further includes a pin contact assembly, contained within the receptacle body, with an attached cable extending from the rear of the connector body.

According to a third aspect of the invention, there is provided chassis connector receptacle design intended to be manufactured directly into a user's component chassis. This allows the chassis design and configuration to remain as independent as possible from the connector receptacle design. Also, this allows the location and orientation of the receptacles to be suited to the user's requirements.

According to a fourth aspect of the invention, there is provided a chassis mountable connector receptacle, which includes an outer body. The chassis mountable connector receptacle also includes a socket contact assembly, with attached wires, contained within the outer body. The chassis mountable connector receptacle has particular mechanical features intended for allowing fastening to a chassis such as screw holes or provisions for other methods of attachment.

According to a fifth aspect of the invention, there is provided a method for inserting a contact assembly with attached cable into the plug body or receptacle body, as the case may be. This method includes pressing the pin or socket contact assembly into the plug or receptacle body with the shield conductor contained tightly between the contact assembly insulator and the plug or receptacle body, thereby causing good electrical connection to the shield conductor.

When a user wishes to couple the connector plug to a mating receptacle, the user aligns and inserts the connector plug into the corresponding opening of the receptacle. As the connector plug begins to slide into the receptacle, the inclined plane surface of the catch contacts the edge of the receptacle opening. As the connector plug slides further into the receptacle, the latch pivots about the hinge pin and the catch compresses into the slot, overcoming the pressure of the elastomeric spring. The depression of the latch is allowed by the deformation of the elastomeric material. At this point, the fit between the plug body and the receptacle body ensures proper alignment of the electrical contact pins and sockets, as they begin to mate together. As the connector plug slides yet further into the receptacle, the catch compresses fully within the profile of the plug body and slides against the inner surface of the receptacle. The contact pins and sockets continue to mate together. Finally, as the plug body nears the bottom of the receptacle opening, the pin and socket contacts become fully mated and the catch finds the opening on the top inside surface of the receptacle opening and springs outward securing the plug into the receptacle and indicating to the user that plug and receptacle are fully and properly mated with a click sound and feel. When the user wishes to de-couple the connector plug from the mating receptacle, the user applies a squeezing force between the top surface of the latch and the bottom of the plug body, forcing the catch clear of the catch opening and below the profile of the plug body. The user, while maintaining the squeezing force, then applies a force of withdrawal away from the receptacle, thereby separating the connector plug from the receptacle.

BRIEF DESCRIPTION OF THE DRAWINGS

The foregoing advantages and features of the invention will become apparent upon reference to the following detailed description and the accompanying drawings. The drawings are organized to show the primary components of the invention, identifying each major element. Some elements are common to more than one component. No illustration is provided for the chassis mountable connector receptacle (fourth aspect of the invention) as the concept may be derived from the chassis connector receptacle (third aspect of the invention). Some hidden lines have been omitted for clarity.

FIG. 2A is a top view, FIG. 2B is a side view, FIG. 2C is a bottom view, FIG. 2D is a front view, and FIG. 2E is a rear view;

FIG. 3A is a top view, FIG. 3B is a side view, FIG. 3C is a bottom view, FIG. 3D is a front view, and FIG. 3E is a rear view;

FIG. 4A is a top view, FIG. 4B is a side view, and FIG. 4C is a front view;

FIG. 10A is a top view, FIG. 10B is a side view, FIG. 10C is a bottom view, FIG. 10D is a front view, and FIG. 10E is a rear view;

FIG. 11A is a top view, FIG. 11B is a side view, FIG. 11C is a bottom view, FIG. 11D is a front view, and FIG. 11E is a rear view;

DETAILED DESCRIPTION OF SPECIFIC EMBODIMENTS

Preferred embodiments of the invention will be described in detail with reference to the drawings. For purposes of this description, only the 3-position (3 wire or terminal) version of each embodiment of the invention will be described except where differences in design necessitate separate description. Otherwise it shall be assumed that the 8-position version is similar or the same with regard to the item being described.

Figure 1A:
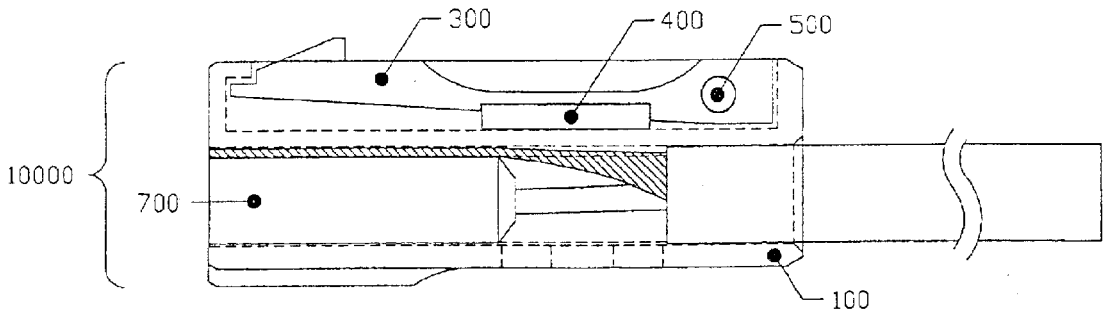
FIG. 1A is a side view diagram of a 3-terminal connector plug assembly that may be utilized in one or more embodiments of the invention.
Figure 1B:
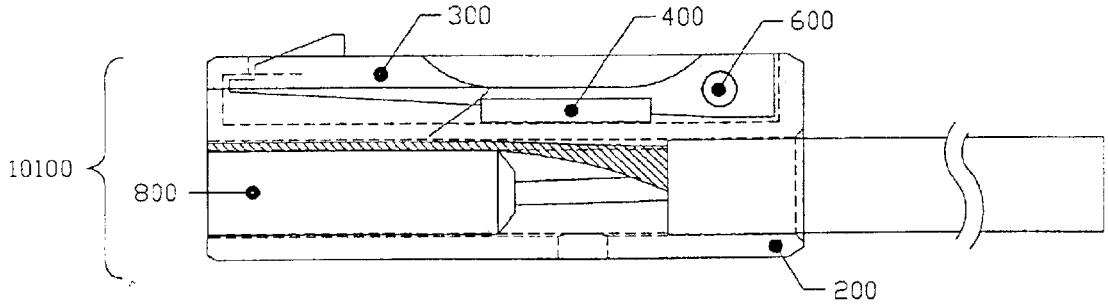
FIG. 1B is a side view diagram of an 8-terminal connector plug assembly that may be utilized in one or more embodiments of the invention.
Figure 2A:
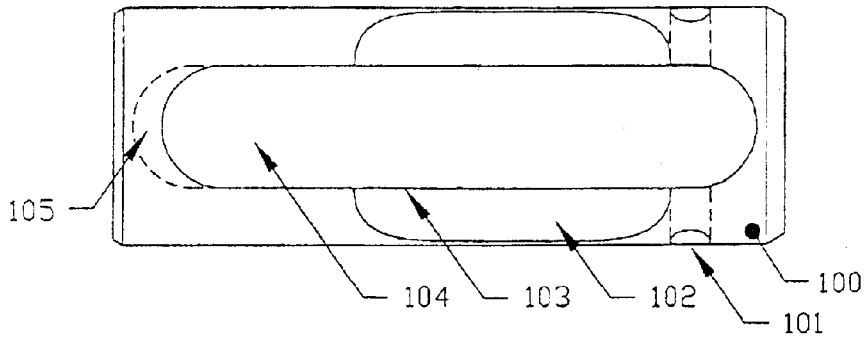
FIGS. 2A through 2E are different views of a 3-position connector plug body that may be utilized in one or more embodiments of the invention, whereby

As seen in FIG. 1A, and referring also to FIG. 2A, a 3-position connector plug assembly 10000 includes a connector plug body 100, a latch 300, an elastomeric spring 400, a hinge pin 500, and a pin contact assembly 700. The latch 300 is shown seated within a latch stop 103 and rests on top of a slot bottom surface 104 of the connector plug body 100. The latch 300 is hingedly coupled to the connector plug body 100 by way of the hinge pin 500. The elastomeric spring 400 is contained between the latch 300 and the slot bottom surface 104 of the connector plug body 100. The pin contact assembly 700 is contained within a lower cavity of the connector plug body 100. As seen in FIG. 1B, an 8-position connector plug assembly 10100 includes essentially the same components as the 3-position connector plug assembly 10000 shown in FIG. 1A (whereby it is wider than the 3-position version).

Referring to FIG. 1A and FIGS. 2A through 2E, by way of example and not by way of limitation, the 3-position connector plug body 100 is 0.35" in length, 0.12" in width, and 0.12" in height. Referring to FIG. 1B and FIGS. 3A through 3E, by way of example and not by way of limitation, the 8-position plug body 200 is 0.25" in width. Of course, other sizes for these components may be envisioned, while remaining within the scope of the invention as described. Referring to FIGS. 2A through 2E, the 3-position connector plug body 100 includes a hinge pin hole 101, a finger relief 102, a latch slot 103, a slot bottom surface 104, a latch stop undercut 105, a pin contact assembly cavity 106, a polarization key 107, fill holes 108, a wire hole 109, and a chamfer 110. Referring to FIGS. 3A through 3E, the 8-position connector plug body 200 has the same features as the 3-position connector plug body 100, except it has a special shape instead of a polarization key to prevent incorrect mating to a mating receptacle.

The latch 300 will now be described with reference to FIGS. 4A through 4C. By way of example and not by way of the limitation, the latch 300 is 0.06" wide and 0.32" long. Of course, other sizes for the latch 300 may be envisioned, while remaining within the scope of the invention. The latch 300 includes a hinge pin hole 301, a top surface 302, a catch surface 303, an inclined plane surface 304, a latch stop lip 305, a catch 306, a bottom surface 307, and an elastomeric spring cavity 308.

Figure 4A:
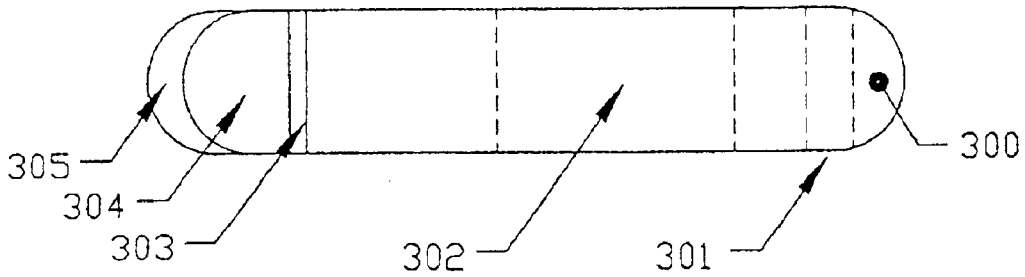
FIGS. 4A, 4B and 4C are different views of a latch that may be utilized in one or more embodiments of the invention, whereby

Referring now to FIG. 4A, the front end of the latch 300 has a curved surface for both its inclined plane surface 304 and for its latch stop lip 305. These curved surfaces are preferably semicircular in shape, but other curved surfaces or even straight surfaces are possible, while remaining within the scope of the invention as described herein. The curved surfaces are provided primarily for ease in manufacturing the latch 300.

Figure 4B:
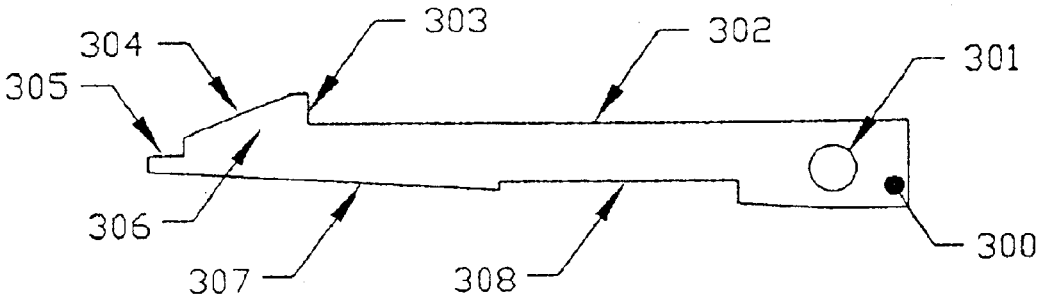
Figure 4C:
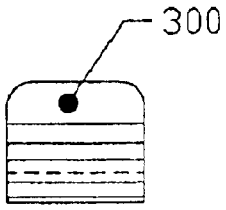

Referring now to FIG. 4B, the front end of the latch 300 has a stepped structure, which is due to the disposition of the inclined plane surface 304 with respect to the latch stop lip 305 and the latch top surface 302.

Referring also to FIG. 1A, the latch stop lip 305 is disposed beneath an extruding wall portion of the connector plug body 100, to thereby keep the latch 300 from extending too far out from the connector plug body 100. Due to an outward force provided to the latch 300 by way of the elastometer spring 400, the latch 300 is urged outwards, so that part of the inclined plane surface 304 extends above the topmost portion of the connector plug body 100. The latch stop lip 305, due to its upward motion being limited by way of the extruding wall portion of the connector plug body 100, keeps the latch 300 from extending too far out from the connector plug body 100. As shown in FIG. 1A, the top half portion of the inclined plane surface 304 extends above the topmost portion of the connector plug body 300. For example, the upper-most 0.010" of inclined plane surface 304 may extend above the connector plug body 300. Of course, other amounts of extension may be contemplated (e.g., ¼ to ¾ of the height of the inclined plane surface 304) while remaining within the scope of the invention. The inclined plane surface may be sloped at an amount between 20 degrees to 75 degrees, for example.

In a (not shown) second embodiment, instead of hingedly connecting the latch to the connector plug body by way of a hinge pin as is done in the first embodiment, the latch is formed integral with and is a part of a top surface, or ceiling, of the connector plug body. In the second embodiment, no hinge pins are needed to couple the latch to the connector plug body, since the latch is formed as an integral part of the connector plug body during a machining process for forming the connector plug body. In the second embodiment, the latch operates as a cantilever.

In either the first or second embodiments, when a user desires to couple the connector plug assembly 10000 to a mating receptacle, the user simply pushes the connector plug assembly 10000 into an opening that is sized to accept the connector plug assembly 10000. The inclined plane surface 304 of the latch 300 rides along a top surface, or ceiling, of the mating receptacle, thereby pushing the latch 300 to beneath the topmost portion of the connector plug body 100. At a point where the connector plug assembly 10000 is correctly mated to the mating receptacle, the inclined plane surface 304 is disposed beneath an opening, or slot, or the top surface of the mating receptacle, whereby the inclined plane surface 304 is urged (by the outwards force applied to the latch 300 by the elastometer spring 400) upwards and into the opening, and "clicks" into place within the opening. With such a configuration, the latch 300 helps maintain the connector plug assembly 10000 in its mated position with respect to the mating receptacle, since a "pulling away" movement of the connector plug assembly 10000 is not allowed due to the inclined plane surface 304 of the latch 300 being maintained within the opening on the top surface of the mating receptacle (by way of the catch surface 303 being substantially orthogonal with respect to a plane defining the opening on the top surface of the mating receptacle).

When the user wants to remove the connector plug assembly 10000 from the mating receptacle that it is coupled to, the user only has to press downwards on the inclined plane surface 304 that extends slightly above the opening on the top surface of the mating receptacle, while at the same time pulling the connector plug assembly 10000 outwards from the mating receptacle.

The connector plug body 100 and the latch 300 are preferably Computer Numerical Control (CNC) machined from solid 6061-T6 aluminum and plated with nickel. Of course, other materials for these components such as brass, zinc, steel or plastic with conductive plating may be envisioned, while remaining within the scope of the invention as described herein. An important consideration is that the material be sufficiently strong, resistant to wear and conductive on the surface. Similarly, other methods of fabrication such as die casting, forging or molding may be envisioned, while remaining within the scope of the invention as described herein. Although other methods of fabrication may be envisioned, in the first and second embodiments, the shape and geometry of the connector plug body 100 and the latch 300 are constructed to allow complete fabrication with only CNC machinery. Furthermore, it is designed to minimize the number and complexity of fabrication steps and operations to minimize fabrication cost.

Figure 5A:
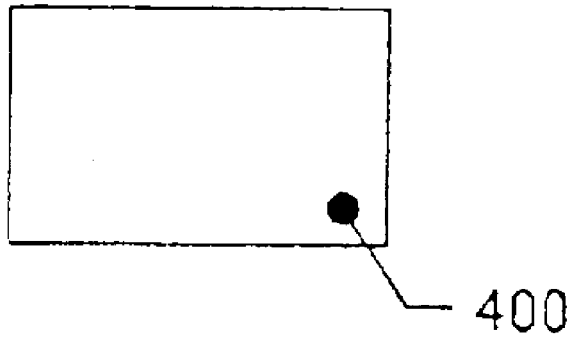
FIGS. 5A and 5B are respectively top and side views of an elastomeric spring that may be utilized in one or more embodiments of the invention.
Figure 5B:
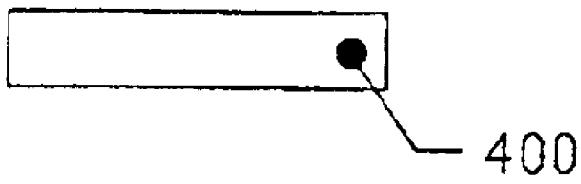
Figure 6A:
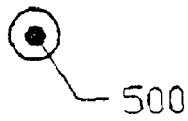
FIGS. 6A and 6B are respectively end and side views of a hinge pin for a 3-position connector plug that may be utilized in one or more embodiments of the invention.
Figure 6B:
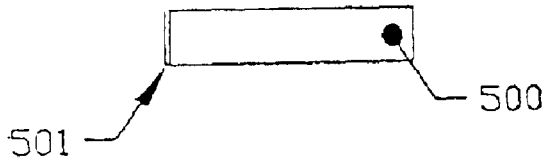
Figure 6C:
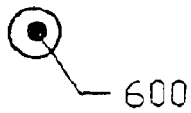
FIGS. 6C and 6D are respectively end and side views of a hinge pin for an 8-position connector plug that may be utilized in one or more embodiments of the invention.
Figure 6D:
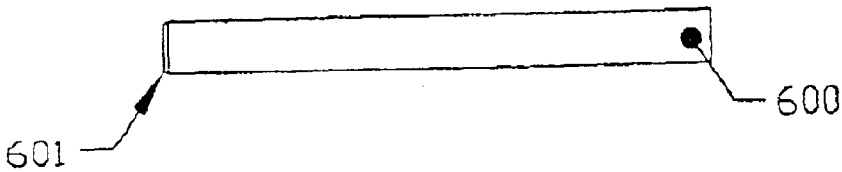
Figure 7A:
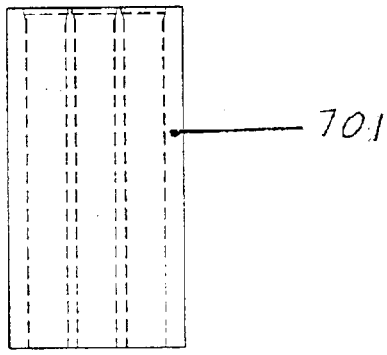
FIGS. 7A and 7B are respectively top and side views of a 3-position pin insulator as used in a 3-position pin contact assembly, which may be utilized in one or more embodiments of the invention.
Figure 7B:
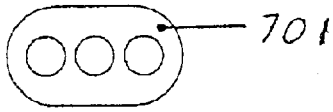
Figure 7C:
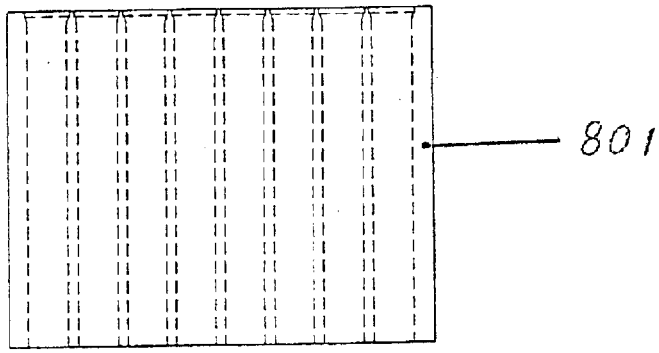
FIGS. 7C and 7D are respectively top and side views of an 8-position pin insulator as used in an 8-position pin contact assembly, which may be utilized in one or more embodiments of the invention.
Figure 7D:
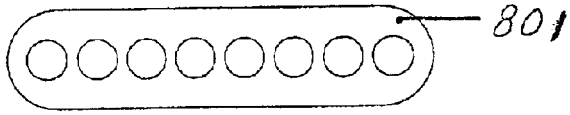

The elastomeric spring 400 will now be explained in detail. FIGS. 5A and 5B show the elastomeric spring 400, which in the first embodiment is 0.10" long, 0.06" wide, and 0.02" thick. Of course, other sizes and shapes for the elastomeric spring 400 may be envisioned, while remaining within the scope of the invention. For example, the elastomeric spring may have a circular shape, with a 0.055" diameter and a 0.03" thickness, for example. The elastomeric spring material is preferably a soft silicone rubber material. Other materials, for example, plastic or metal spring, or other synthetic elastomeric materials could be substituted, while remaining within the scope of the invention.

Referring now to FIGS. 1A, 2A, 4B, 5A and 5B, when inserted into the connector plug assembly 10000, the elastometer spring 400 is situated beneath the elastometer spring cavity 308 and above the slot bottom surface 104, in a snug fit that provides for a slight compression of the elastometer spring 400. Due to its spongy constitution, the elastometer spring 400, in its slightly compressed state within the connector plug assembly 10000, exerts an outwards force onto the latch 300, thereby urging the inclined plane surface 304 of the latch 300 to extend above the topmost portion of the connector plug body 300.

The hinge pin 500, 600 will now be described with reference to FIGS. 6A through 6D. By way of example and not by way of limitation, the 3-position hinge pin 500 is 0.10" long and 0.021" in diameter, and the 8-position hinge pin 600 is 0.22" long and 0.021" in diameter. Of course, other sizes for the hinge pin 500, 600 may be envisioned, while remaining within the scope of the invention. The hinge pin 500, 600 is preferably a stainless steel part to provide the desired strength and corrosion resistance, but may alternatively be another type of metal or plastic material having similar properties.

As explained earlier, in the first embodiment, the hinge pin 500 is situated within the hinge pin hole 101 of the connector plug body 100, and allows for the latch 300 to pivot with respect to the connector plug body 100.

FIGS. 7A through 7D show the 3- and 8-position pin contact insulator bodies 701, 801 prior to being assembled to cables and contacts. The insulator material is preferably Vectra LCP glass reinforced resin, although other materials could be substituted that have appropriate conductor insulation properties, while remaining within the scope of the invention.

Figure 8A:
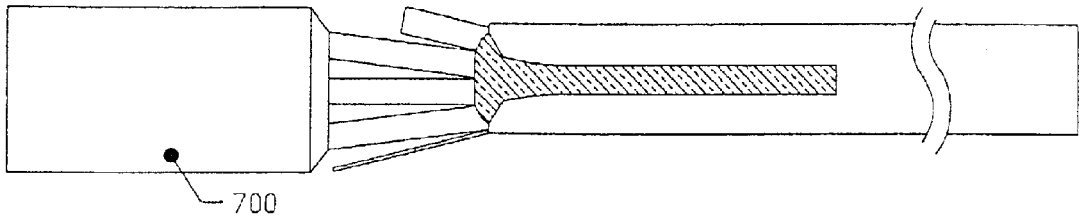
FIG. 8A is a top view of a 3-position pin contact assembly that may be utilized in one or more embodiments of the invention.
Figure 8B:
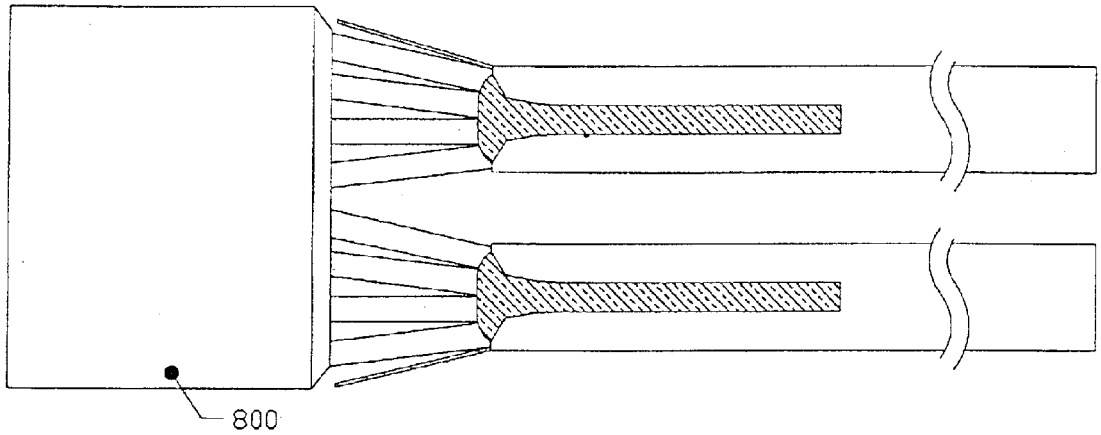
FIG. 8B is a top view of an 8-position pin contact assembly that may be utilized in one or more embodiments of the invention.

FIG. 8A shows a 3-position pin contact assembly 700, which, by way of example and not by way of limitation, is 0.05" thick and 0.09" wide. Of course, other sizes for these components may be envisioned, while remaining within the scope of the invention as described. FIG. 8B shows an 8-position pin contact assembly 800 that holds two cables instead of one. FIG. 1A shows the disposition of the 3-position pin contact assembly 700 within the 3-terminal connector plug assembly 10000, and FIG. 1B shows the disposition of the 8-position pin contact assembly 800 within the 8-terminal connector plug assembly 10100.

The connector plug body 100 is designed to be as small as possible (e.g., for use in clandestine operations), especially in width and height, while maintaining its intended design characteristics such as durability and ease of use. The particular profile that includes key 107 (see FIGS. 2B, 2C and 2D, in particular), is provided in order to prevent the connector plug body 100 from inserted into its counterpart 3-position mating receptacle at an improper orientation, or from being improperly inserted into an 8-position mating receptacle.

The connector plug body 100 contains a slot 103 which is machined into its top surface in which the latch 300 is located and hingedly coupled by means of an interference fitted hinge pin 500. The hinge pin 500 is pressed into place through the hinge pin hole 101 on either end of the connector plug body 100. In a preferred construction, one end of the hinge pin 500 is chamfered to minimize damage during the insertion process. The hinge pin 500 fits with a slight clearance within the diameter of the hinge pin hole 101 of the connector plug body 300. The hinge pin 500 fits with a slight interference within the diameter of the hinge pin hole 301 of the latch 300 (see FIG. 4B). This interference fit is sufficient to prevent inadvertent movement or loss of the hinge pin 500. This provides a strong, hinged coupling of the latch 300 to the connector plug body 100, while at the same time allowing the latch 300 to be pivoted a small amount (e.g., 10 to 25 degrees) with respect to the connector plug body 100.

Contained between the elastomeric spring cavity 308 of the latch 300 and the bottom surface of the slot 304 within the plug body 100 is the elastomeric spring 400. Normally the elastomeric spring 400 is under slight compression causing an outward preload pressure against the latch 300 and causing firm contact between the latch stop lip 305 of the latch 300 and the latch stop undercut 105 of the connector plug body 100. Upward rotation of the latch 300 about the hinge pin 500 is limited by contact between the latch stop lip 305 of the latch and the latch stop undercut 105 of the connector plug body 100. Downward rotation of the latch 300 about the hinge pin 500 is limited by contact between the latch bottom surface 307 and the bottom surface of the slot 104 within the plug body 100. Axial movement of the latch 300 is minimized due to a close fit within the latch slot 103 and subsequent contact of the sides of the latch 300 with the sides of the latch slot 103.

Figure 2B:
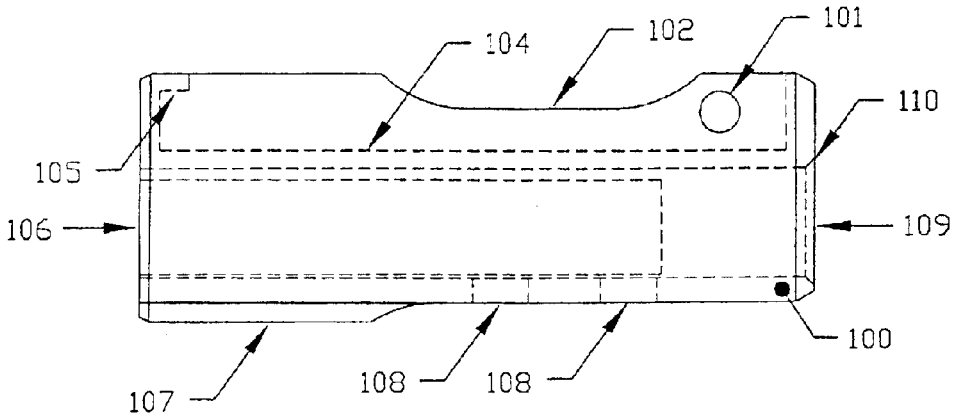
Figure 2C:
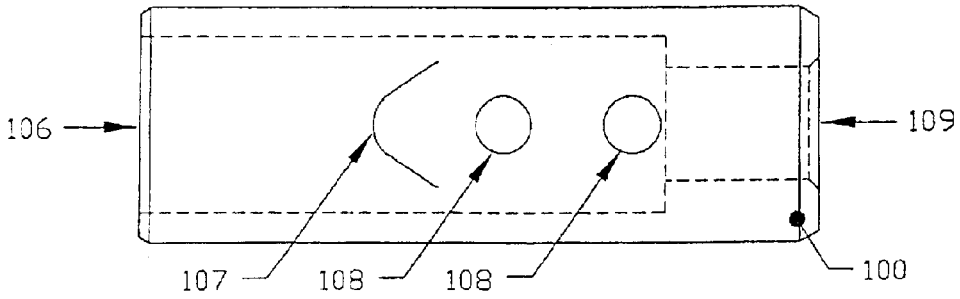
Figure 2D:
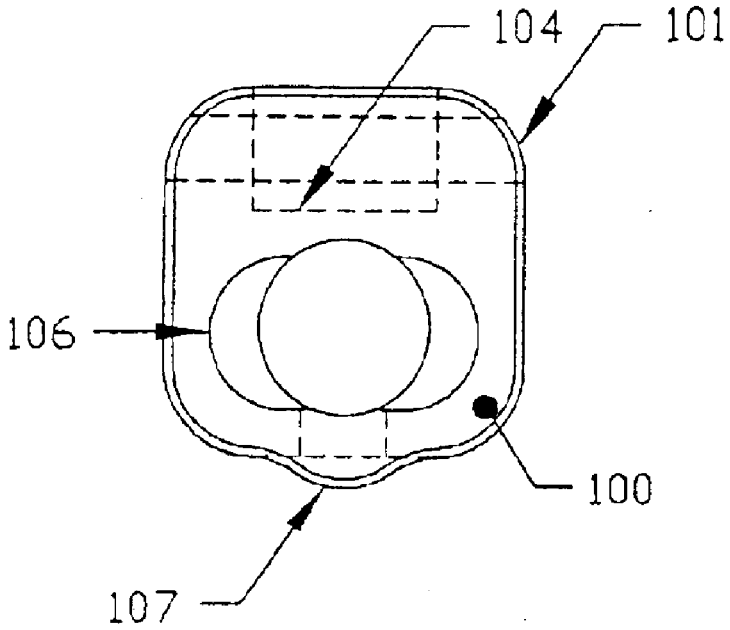
Figure 2E:
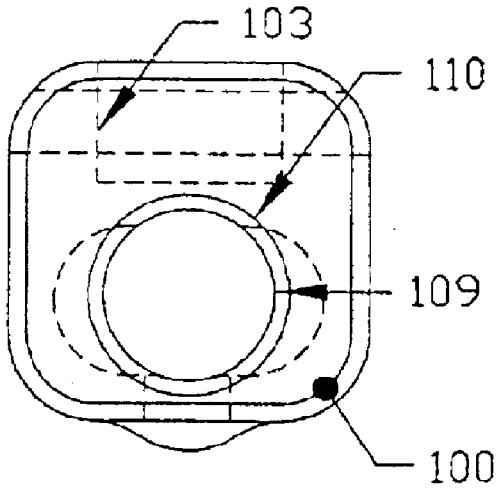
Figure 3A:
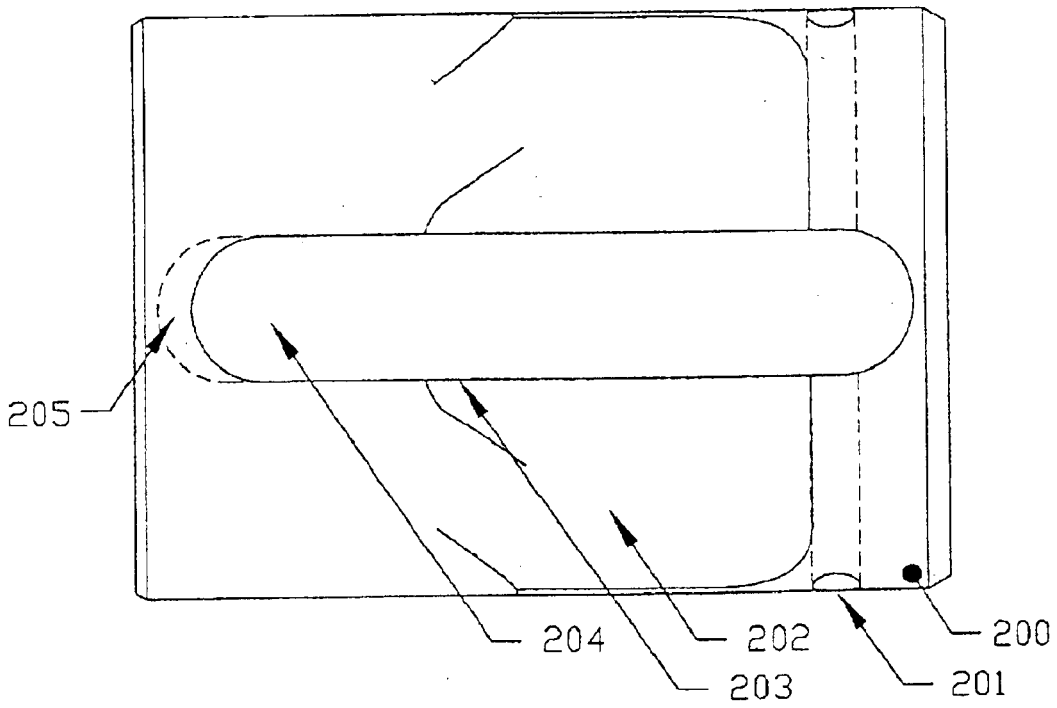
FIGS. 3A through 3E are different views of an 8-position connector plug body that may be utilized in one or more embodiments of the invention, whereby
Figure 3B:
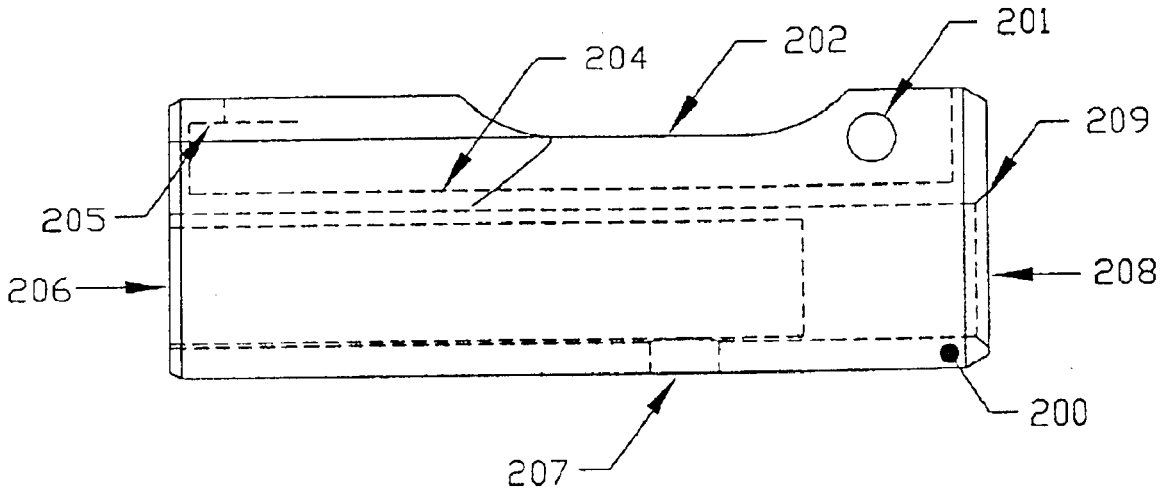
Figure 3C:
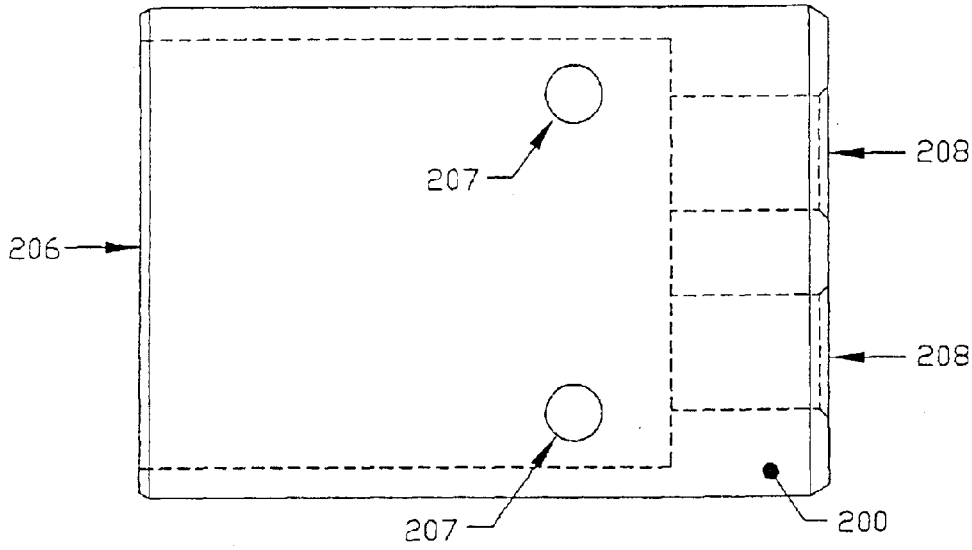
Figure 3D:
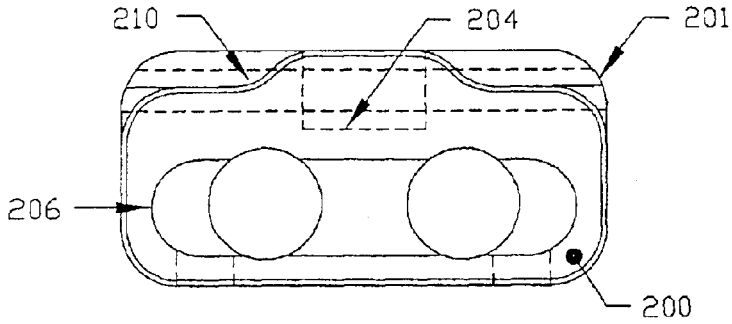
Figure 3E:
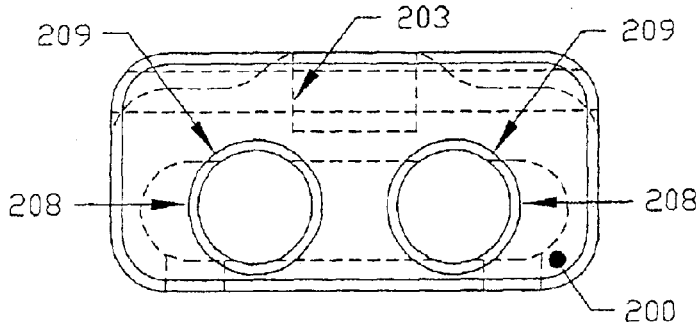

The front edge of the connector plug body 100 is chamfered, as shown by chamfer 110 in FIG. 2B, to make insertion into its mating receptacle easier, whereby the amount of chamfer is not too large so as to allow contact misalignment or to require a longer mating travel. For example, a chamber of 0.01" width and at a 45 degree angle may be provided. The back edge of the connector plug body 100 is also preferably chamfered to prevent any sharp edges that may cause user discomfort when the connector plug body 100 is manipulated by a user.

Now, description will be made of mating receptacles, which are elements which the connector plug assemblies described previously are to be mated with in order to provide a conductive coupling of components, according to a third embodiment of the invention.

Figure 9A:
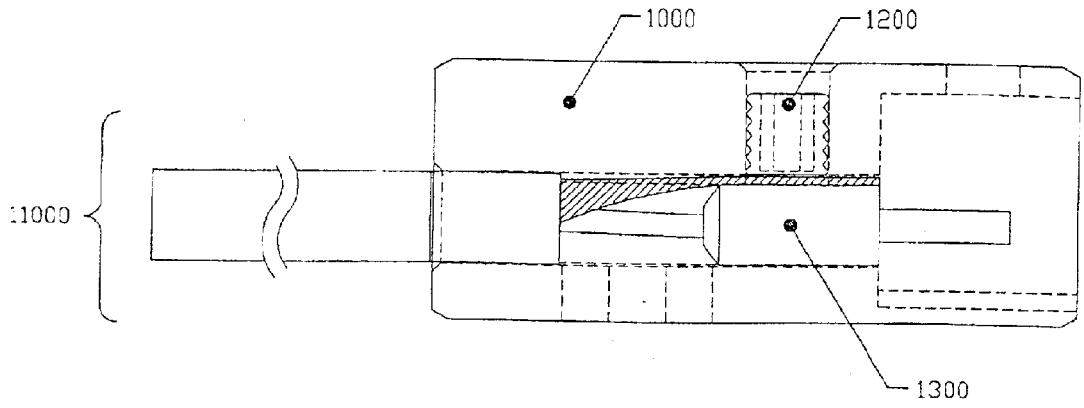
FIG. 9A is a side view diagram of a 3-terminal inline connector receptacle assembly that may be utilized in one or more embodiments of the invention.
Figure 9B:
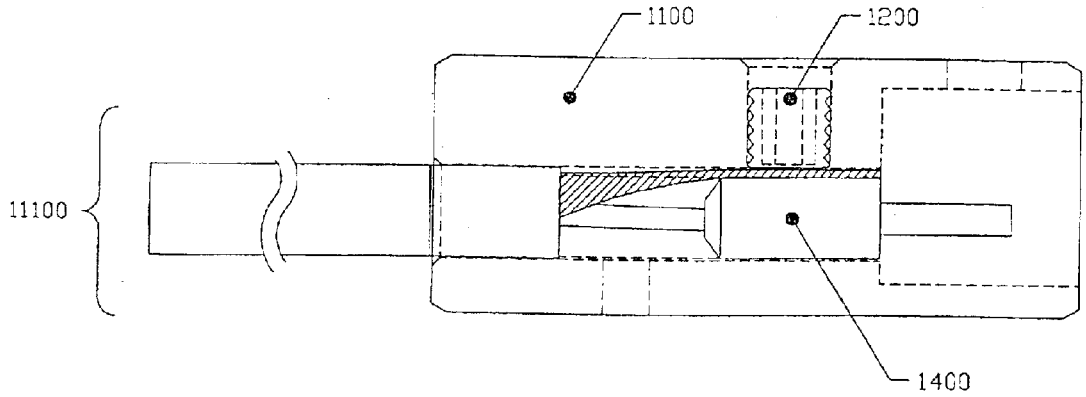
FIG. 9B is a side view diagram of an 8-terminal inline connector receptacle assembly that may be utilized in one or more embodiments of the invention.
Figure 10A:
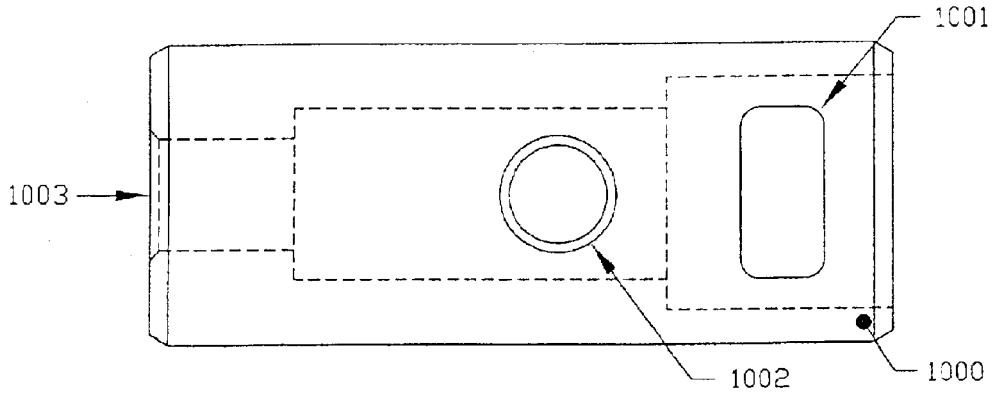
FIGS. 10A through 10E are different views of a 3-position connector receptacle body that may be utilized in one or more embodiments of the invention, whereby
Figure 10B:
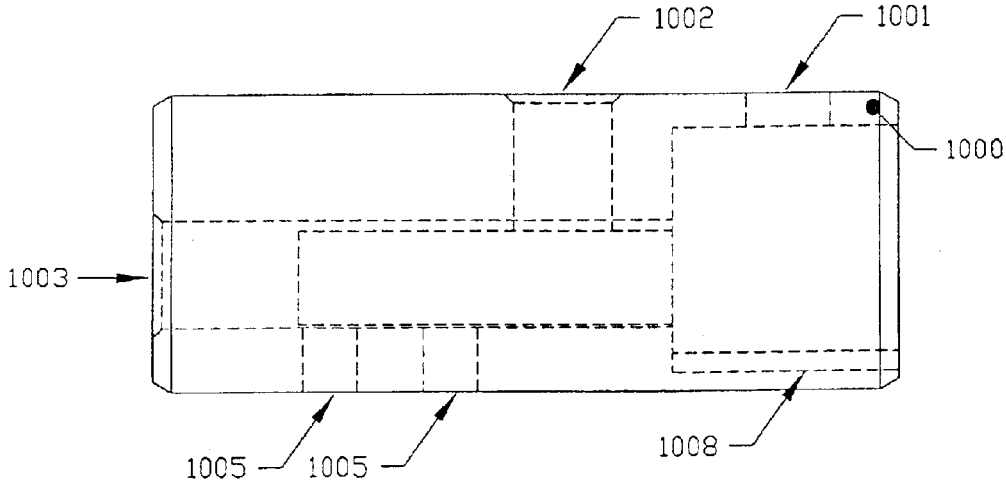
Figure 10C:
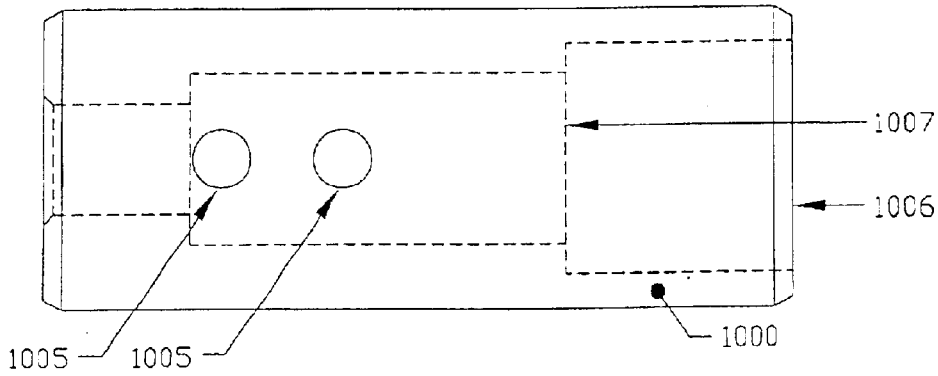
Figure 10D:
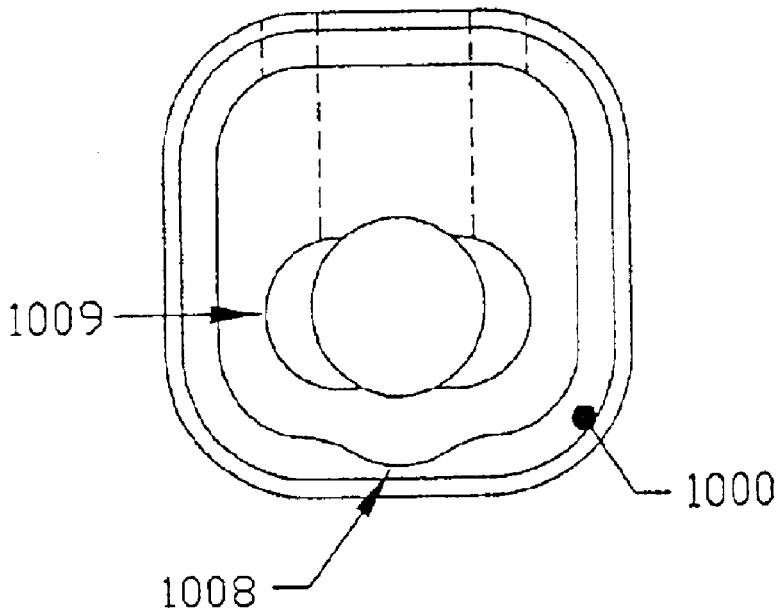
Figure 10E:
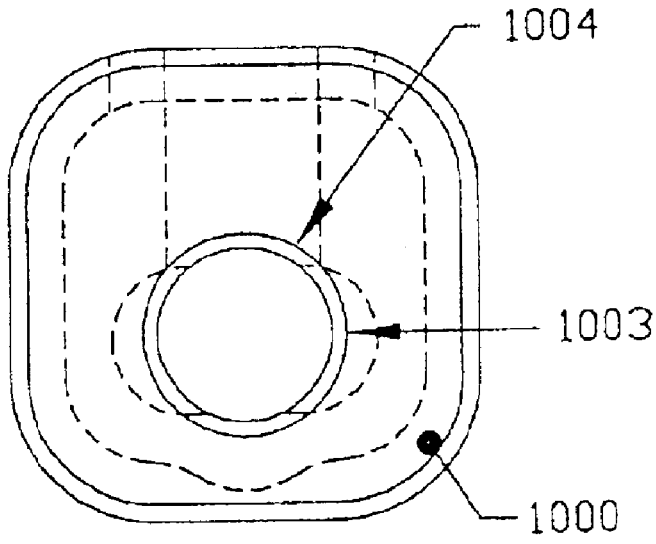
Figure 11A:
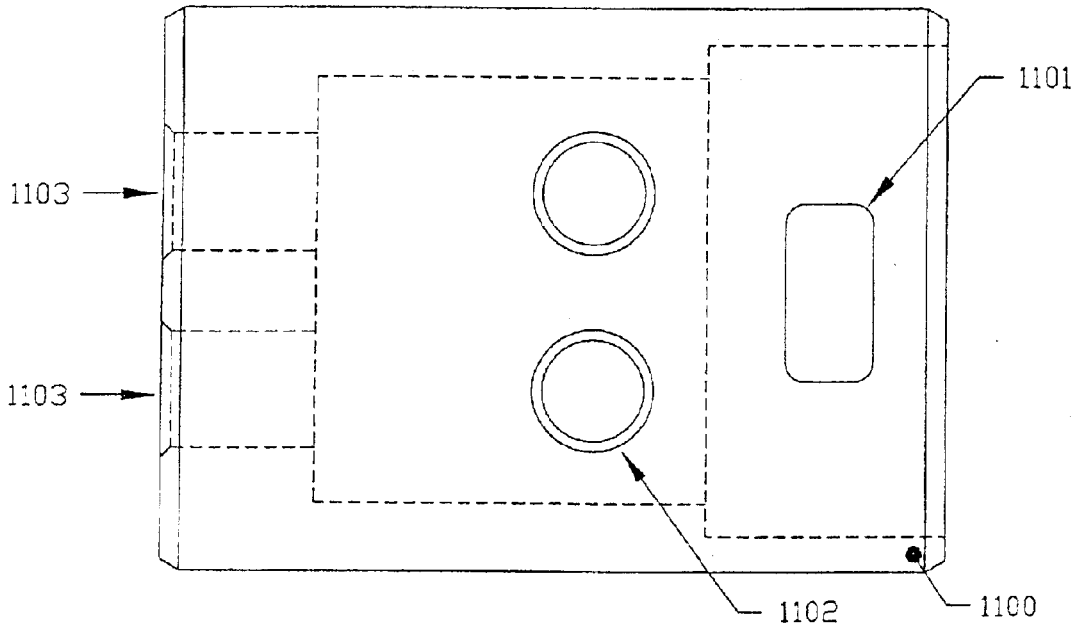
FIGS. 11A through 11E are different views of an 8-position connector receptacle body that may be utilized in one or more embodiments of the invention, whereby
Figure 11B:
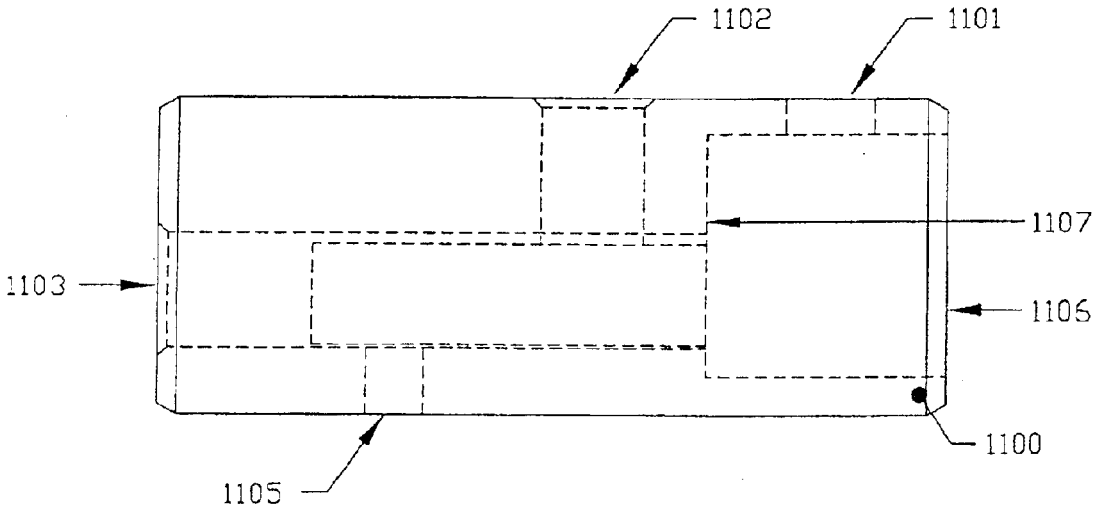
Figure 11C:
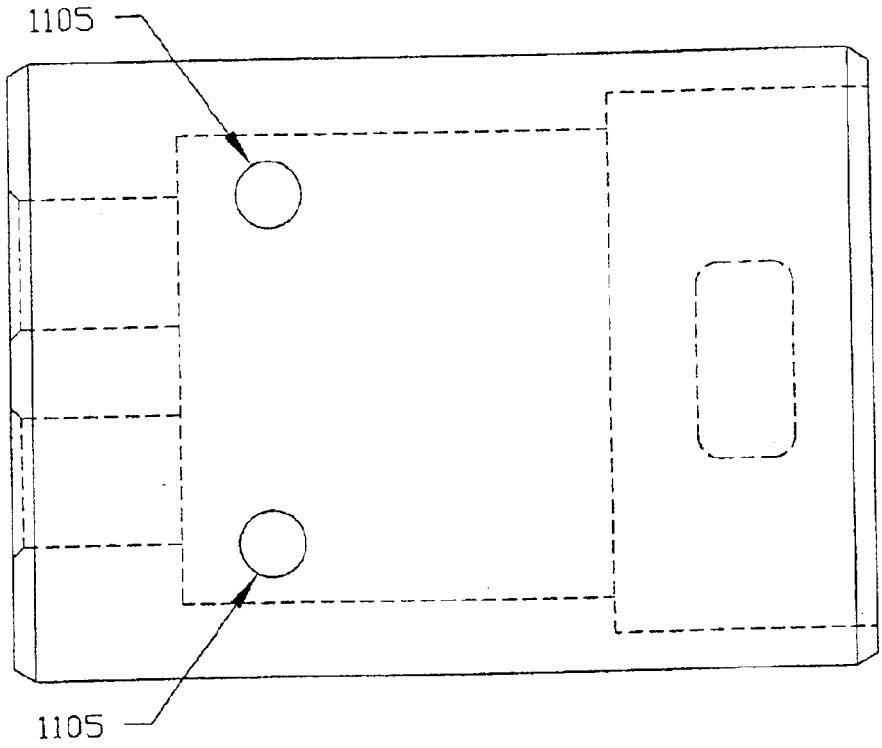
Figure 11D:
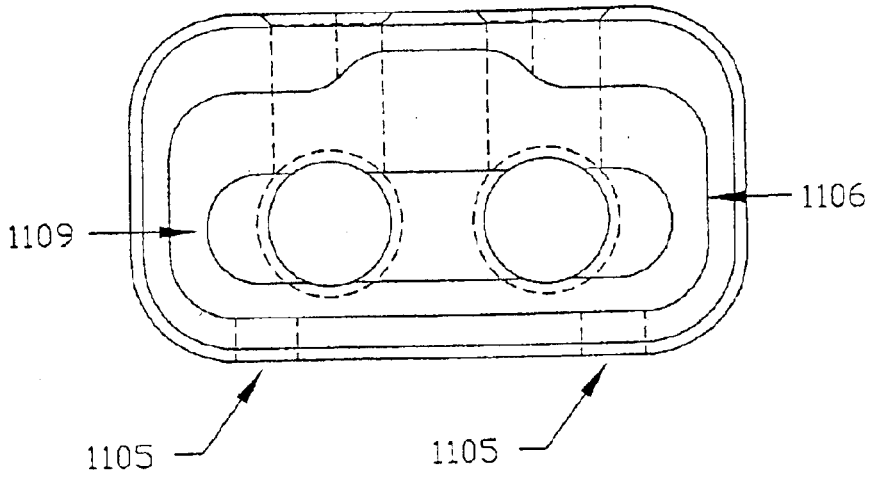
Figure 11E:
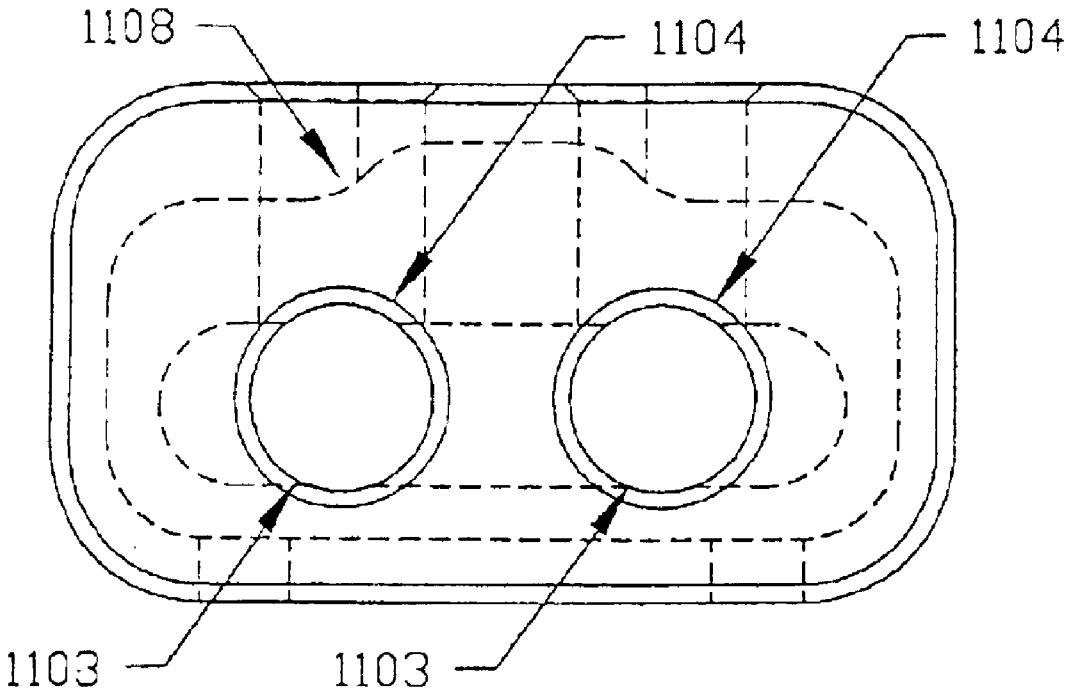

FIG. 9A shows a 3-terminal inline connector receptacle assembly 11000, which is configured and sized so as to mate with the 3-terminal connector plug assembly 10000 shown in FIG. 1A. FIG. 9B shows an 8-terminal inline connector receptacle assembly 11100, which is configured and sized so as to mate with the 8-terminal connector plug assembly 10100 shown in FIG. 1B.

A 3-position inline socket contact assembly 1300 is provided in a lower cavity of the 3-terminal connector receptacle assembly 11000, whereby a 3-position connector receptacle body 1000 is also shown in FIG. 9A. An opening for accepting a set screw 1200 (see FIGS. 12A and 12B) in order to hold the 3-terminal inline socket contact assembly 1300 in place within the 3-terminal inline connector receptacle assembly 11000, is also shown in FIG. 9A.

Similarly, an 8-position inline socket contact assembly 1400 is provided in a lower cavity of the 8-terminal connector receptacle assembly 11100, whereby an 8-position connector receptacle body 1100 is also shown in FIG. 9B. Openings for accepting set screws 1200 (see FIGS. 12A and 12B) in order to hold the 8-terminal inline socket contact assembly 1400 in place within the 8-terminal inline connector receptacle assembly 11100, is also shown in FIG. 9B.

FIGS. 10A through 10E show different views of the 3-position connector receptacle body 1000. The 3-position connector receptacle body 1000 includes a slot or opening 1001, a set screw hole 1002, wire hole 1003, fill holes 1005, front mating surface 1006, socket insulator cavity 1007, and keyed portion 1008.

The slot 1001 on the top surface of the 3-position connector receptacle body 1000 is provided so as to accept the latch stop lip 305 of the 3-position connector plug assembly 10000 when the 3-position connector plug assembly 10000 is mated with the 3-terminal inline connector receptacle assembly 11000. The slot 1001 is sized so as to hold in place the top portion of the latch inclined surface 304, and thereby help keep the 3-position connector plug assembly 10000 mated with the 3-terminal inline connector receptacle assembly 11000 even when those components are subject to heavy vibrations and jostling motions. That way, a conductive coupling of elements using the 3-position connector plug assembly 10000 and the 3-terminal inline connector receptacle assembly 11000 is maintained even under conditions whereby a coupling might otherwise by inadvertently decoupled. For example, for an undercover police operation, it is important that an electrical connection of a "live wire" be maintained, even when an undercover agent is in motion. If the electrical connection becomes decoupled, this may result in a serious problem for the agent. The positive locking mechanism provided by way of the present invention ensures a tight coupling of a small connector plug body to a small mating receptacle under many types of dynamic environmental conditions.

Figure 12A:
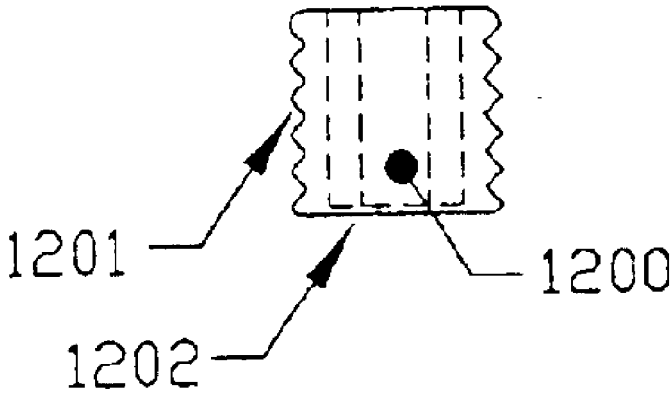
FIGS. 12A and 12B are respectively side and top views of a set screw that may be utilized in one or more embodiments of the invention.
Figure 12B:
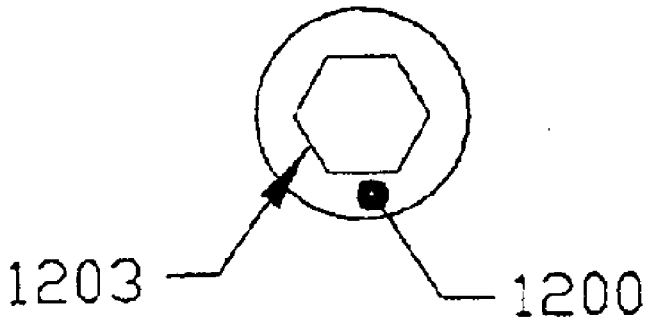

The set screw hole 1002 on the top surface of the 3-position connector receptacle body 1000 is provided to accept a set screw 1200, such as the one shown in FIGS. 12A and 12B. The set screw 1200 holds the 3-position inline socket contact assembly 1300 in place within the 3-position connector receptacle body 100, so as to allow for a precise coupling of the 3-position pin contact assembly 700 of the 3-position connector plug assembly 10000 to the 3-position inline socket contact assembly 1300 of the 3-terminal inline connector receptacle assembly 11000.

Wire hole 1003 is chamfered to easily accept the 3-position inline socket contact assembly 1300, which is fitted therethrough to be seated in the position as shown in FIG. 9A.

Fill holes 1005 are provided on the bottom surface of the 3-position connector receptacle body 1000, whereby epoxy or a similar type of adhesive insulative substance is pumped into the fill holes 1005 in order to secure the socket contact assembly in place and to provide for an internal strain relief function within the cable.

Front mating surface 1006 is sized to accept the front surface (see FIG. 2D) of the connector plug body 100, in a snug fit. Similarly, polarization key 107 of the connector plug body 100 fits snugly into the keyed portion 1008 as the 3-position connector plug body 100 is pushed into and thereby mated with the 3-position connector receptacle body 1000. By way of the polarization key 107, the 3-position connector plug body 100 can be mated with the 3-position connector receptacle body 1000 in only one orientation, to thereby prevent any damage to the sockets and connectors within these components due to an incorrect orientation of these components during a connector/receptacle mating procedure.

Figure 13A:
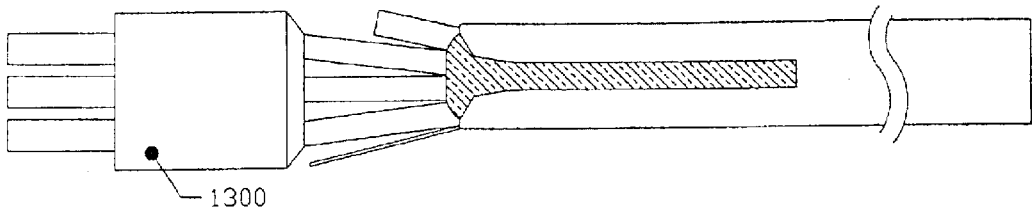
FIG. 13A is a top view of a 3-position inline socket contact assembly that may be utilized in one or more embodiments of the invention.

FIG. 13A shows the 3-position inline socket contact assembly 1300 with cable attached to it.

Figure 13B:
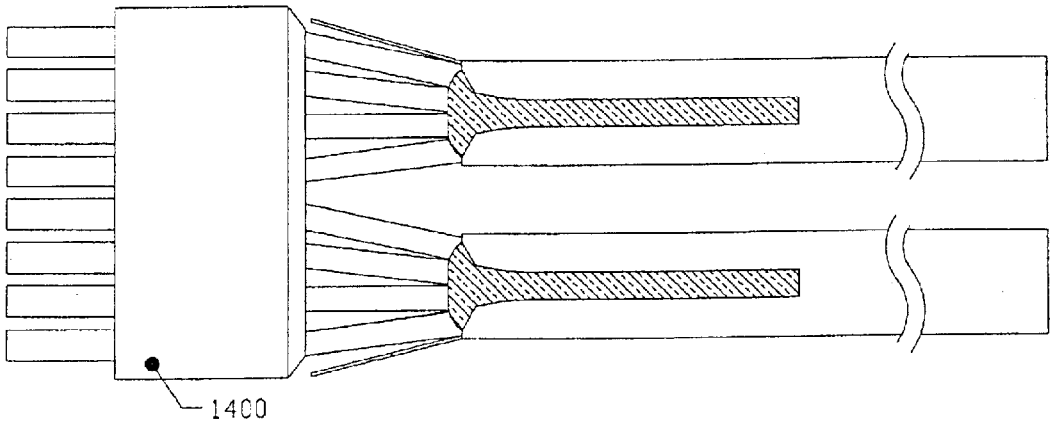
FIG. 13B is a top view of an 8-position inline socket contact assembly that may be utilized in one or more embodiments of the invention.

FIGS. 11A through 11E show different views of the 8-position connector receptacle body 1100, which is configured and sized to mate with the 8-position connector plug body 200 shown in FIG. 1B. The 3-position connector receptacle body 1000 includes a slot or opening 1001, two set screw holes 1002, two wire holes 1003, fill holes 1005, front mating surface 1006, and a socket insulator cavity 1007. The 8-position connector receptacle body 1100 is configured to accept the two separate cables of the 8-position socket contact assembly 1400, as seen best in FIG. 13B. In particular, FIG. 13B shows the 8-position inline socket contact assembly 1400 with cables attached to it.

Now, description will be made of mating receptacles for a printed circuit board (PCB) chassis, according to a fourth embodiment of the invention. These mating receptacles are configured to mate with the connector plug bodies and connector plug assemblies described previously.

Figure 14A:
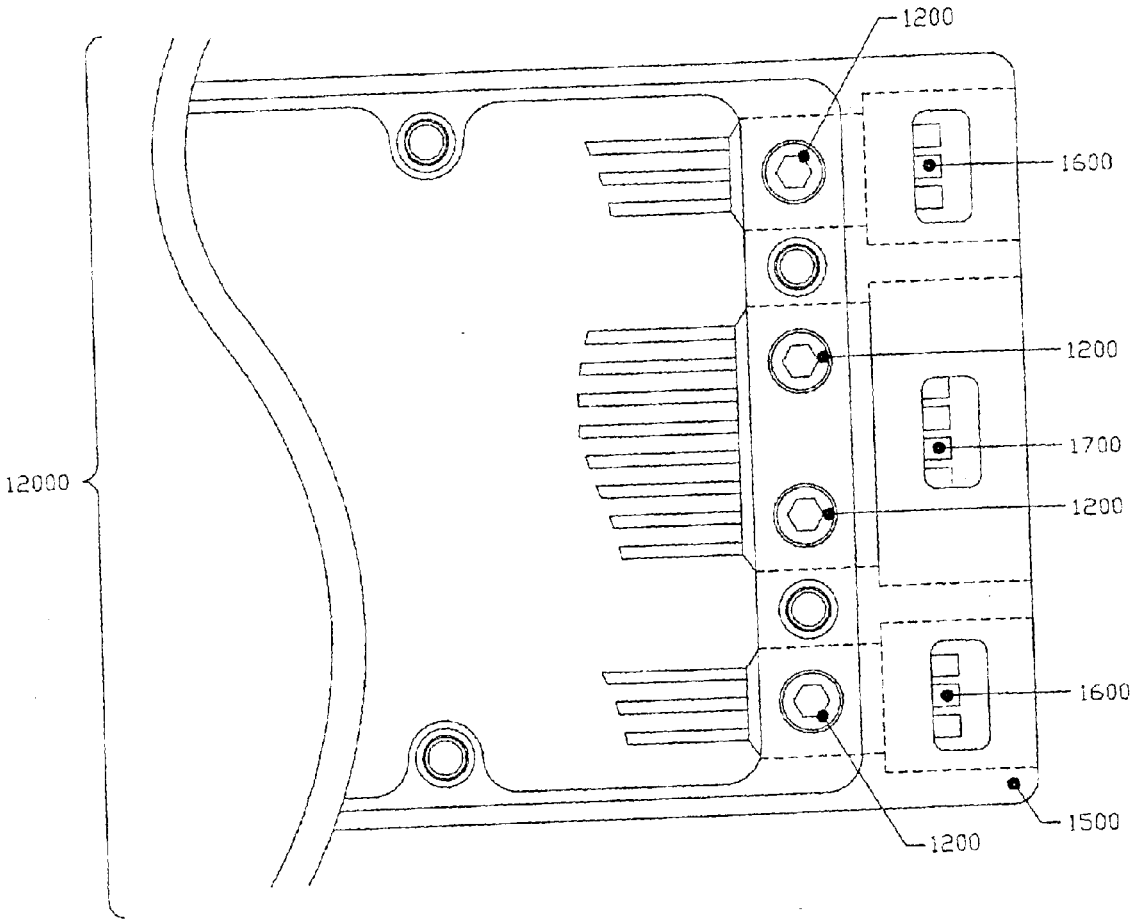
FIG. 14A is a top view diagram of a chassis integrated connector receptacle that may be utilized in one or more embodiments of the invention.
Figure 14B:
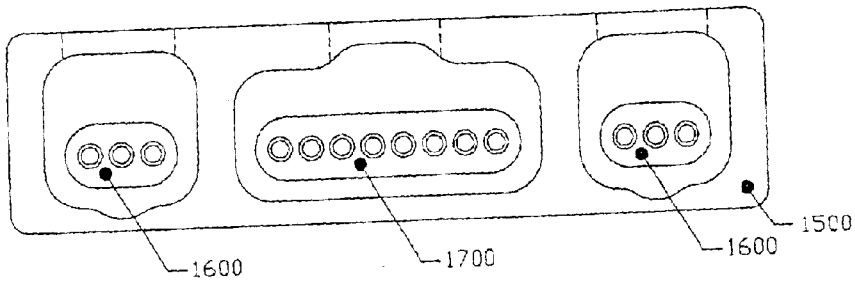
FIG. 14B is an end view diagram of a chassis integrated connector receptacle that may be utilized in one or more embodiments of the invention.

FIG. 14A is a top view diagram of a chassis integrated connector receptacle 1500, which is provided at one end of a chassis 12000, according to the fourth embodiment of the invention. FIG. 14B is an end view diagram of the chassis integrated connector receptacle 1500 according to the fourth embodiment of the invention. The fourth embodiment is described as having two 3-position mating receptacles and a centrally-positioned 8-position mating receptacle, but one of ordinary skill in the art will recognize that other different configurations are possible, while remaining within the scope of the invention.

Figure 15A:
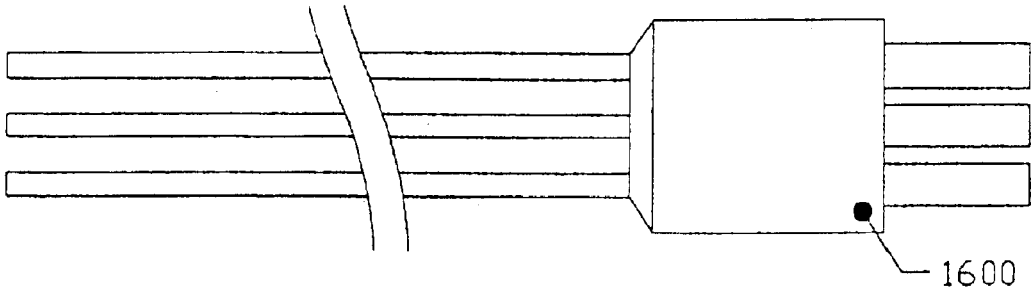
FIG. 15A is a top view of a 3-position printed circuit board (PCB) socket contact assembly that may be utilized in one or more embodiments of the invention.
Figure 15B:
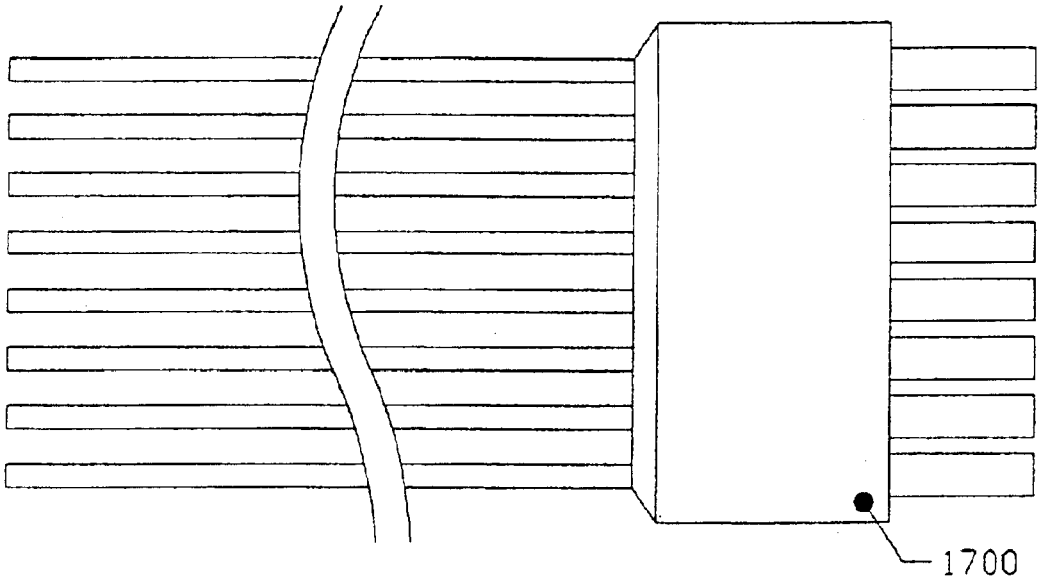
FIG. 15B is a top view of an 8-position PCB socket contact assembly that may be utilized in one or more embodiments of the invention.

FIG. 15A is a top view of a 3-position PCB socket contact assembly 1600, and FIG. 15B is a top view of an 8-position PCB socket contact assembly 1700. The 3-position PCB socket contact assembly 1600 is constructed and sized so as to mate with a 3-position pin contact assembly 700 of a 3-position connector plug assembly 11000 (see FIG. 1A and FIG. 8A), and the 8-position PCB socket contact assembly 1700 is constructed and sized so as to mate with an 8-position pin contact assembly 800 of an 8-position connector plug assembly 10100 (see FIG. 1B and FIG. 8B).

With these components, elements (e.g., microprocessor) coupled to a printed circuit board housed within the chassis

12000 can be coupled to other elements (e.g., microphone) that are not housed on the chassis 12000, by way of the contact assembly/plug assembly matings.

Set screws 1200 are also provided as shown in FIG. 14A, to hold the various elements in place. The slot or opening for each PCB socket contact assembly 1600, 1700 is also shown in FIG. 14A, which is provided so as to hold the latch inclined surface 304 of the counterpart connector plug assembly in place when the counterpart connector plug assembly is mated with the PCB socket contact assembly.

In the first through fourth embodiments, the pins of the connector are of a size whereby adjacent pins of the connector are spaced 0.025" apart, to thereby function as a small sized connector. Of course, other spacings between adjacent pins or sockets of a small sized connector are possible while remaining within the scope of the invention as described herein (e.g., 0.005" to 0.150" apart). Such a small sized connector is typically used in military components, such as those that are subject to military (MIL) specifications (e.g., MIL-C-835 13 specification). Of course, other small sized components in the non-military arena may take advantage of the small sized connectors of the invention, such as components used in policing, in computer networking, or in telecommunications.

A method for inserting a contact assembly with attached cable into the plug body or receptacle body, will now be described in accordance with any of the embodiments of the invention described previously. This method includes pressing the pin or socket contact assembly into the plug or receptacle body with the shield conductor contained tightly between the contact assembly insulator and the plug or receptacle body, thereby causing good electrical connection to the shield conductor.

When a user wishes to couple the connector plug to a mating receptacle, the user aligns and inserts the connector plug into the corresponding opening of the receptacle. As the connector plug begins to slide into the receptacle, the inclined plane surface of the catch contacts the edge of the receptacle opening. As the connector plug slides further into the receptacle, the latch pivots about the hinge pin and the catch compresses into the slot, overcoming the pressure of the elastomeric spring. The depression of the latch is allowed by the deformation of the elastomeric material. At this point, the fit between the plug body and the receptacle body ensures proper alignment of the electrical contact pins and sockets, as they begin to mate together. As the connector plug slides yet further into the receptacle, the catch compresses fully within the profile of the plug body and slides against the inner surface of the receptacle. The contact pins and sockets continue to mate together. Finally, as the plug body nears the bottom of the receptacle opening, the pin and socket contacts become fully mated and the catch finds the opening on the top inside surface of the receptacle opening and springs outward securing the plug into the receptacle and indicating to the user that plug and receptacle are fully and properly mated with a click sound and feel. When the user wishes to de-couple the connector plug from the mating receptacle, the user applies a squeezing force between the top surface of the latch and the bottom of the plug body, forcing the catch clear of the catch opening and below the profile of the plug body. The user, while maintaining the squeezing force, then applies a force of withdrawal away from the receptacle, thereby separating the connector plug from the receptacle.

Thus, a small sized connector and a method for connecting a small wire assembly to a small electrical component using a small sized connector have been described according to several embodiments of the present invention. Many modifications and variations may be made to the techniques and structures described and illustrated herein without departing from the spirit and scope of the invention. Accordingly, it should be understood that the methods and apparatus described herein are illustrative only and are not limiting upon the scope of the invention. For example, to aid in removing the connector plug body from the connector receptacle, an operator may push downwards on the raised portion of the latch within the slot, such as by using one's fingernail or a tool (e.g., tip of a ball point pen) to press the raised portion of the latch to a position beneath the slot, while at the same time pushing the connector plug body in a direction away from the connector receptacle.

Additionally, while the embodiments of the invention have been described with reference to 3-position and 8-position assemblies, one of ordinary skill in the art will recognize that other numbers of pins and sockets may be utilized, while remaining within the scope of the invention as described herein.

What is claimed is:

1. A connector plug, comprising:

a housing;

a latch that is disposed on a top portion of the housing, wherein the latch includes a top surface, a raised catch at one end of the top surface, and a finger pressing region at a middle portion of the top surface of the latch;

an elastomeric material that is provided beneath the finger pressing region of the latch; and a pin contact assembly contained within the housing, wherein a cable attached to the pin contact assembly extends out from a rear of the housing, wherein the housing includes a top region in which the latch and the elastomeric material are disposed, an inner shelf on which the elastomeric material rests upon, and a bottom region in which the pin contact assembly is disposed, wherein the inner shelf from a proximal end to a distal end of the housing and divides the top region of the housing from the bottom region of the housing, wherein the elastomeric material provides an outward pressure against the latch to enable the connector plug to be coupled to a connector receptacle in a detachable manner.

2. The connector plug according to claim 1, wherein the housing further comprises an overhanging portion, wherein the latch includes a lip portion at one end of the latch, and wherein the latch is disposed on the top portion of the housing such that the lip portion of the latch is located underneath the overhanging portion of the housing, to thereby always maintain the lip portion of the latch underneath the overhanging portion of the housing to create a stop to the outward pressure provided to the latch by way of the elastomeric material.

3. The connector plug according to claim 1, wherein the bottom region of the housing is shaped so as to only accept the pin contact assembly when placed into the housing at a particular orientation.

4. The connector plug according to claim 1, wherein the housing further comprises two fill holes provided on a bottom surface of the bottom region of the housing, wherein a filling material is inserted into the housing through at least one of the two fill holes, to thereby secure the pin contact assembly in place within the bottom region of the housing.

5. The connector plug according to claim 1, wherein the housing of the connector plug provides an electric shielding/grounding structure for components disposed therewithin.

6. The connector plug according to claim 1, wherein the connector plug is a miniaturized component that is approximately 0.35" in length, 0.12" in width, and 0.12" in height.

7. A connector plug, comprising:

a housing;

a latch that is disposed on a top portion of the housing, wherein the latch includes a top surface, a raised catch at one end of the top surface, and a finger pressing region at a middle portion of the top surface of the latch; and an elastomeric material that is provided beneath the finger pressing region of the latch, wherein the elastomeric material provides an outward pressure against the latch to enable the connector plug to be coupled to a connector receptacle in a detachable manner, and wherein the latch further comprises a cavity region provided on a bottom surface of the latch, the cavity region sized so as to accept a top portion of the elastomeric material when the elastomeric material and the latch are disposed within the housing.

8. A connector plug, comprising:

a housing;

a latch that is disposed on a top portion of the housing, wherein the latch includes a top surface, a raised catch at one end of the top surface, and a finger pressing region at a middle portion of the top surface of the latch; and an elastomeric material that is provided beneath the finger pressing region of the latch, wherein the elastomeric material provides an outward pressure against the latch to enable the connector plug to be coupled to a connector receptacle in a detachable manner, and wherein the raised catch of the latch comprises:

a lower curved portion that is substantially parallel to the top surface of the latch;

an inclined portion that extends along an inclined angle with respect to the top surface of the latch; and a catch surface that is substantially perpendicular to the top surface of the latch.

9. The connector plug according to claim 8, wherein the inclined angle of the inclined portion of the latch is an angle between 20 degrees and 75 degrees.

10. An inline connector assembly, comprising:

a connector plug that includes, a housing that includes a top region, a bottom region, and a dividing shelf that divides the top region from the bottom region;

a latch that is disposed on a top portion of the housing, wherein the latch includes a top surface and a raised catch at one end of the top surface; and an elastomeric material that is provided beneath the latch, wherein the elastomeric material rests against a top surface of the dividing shelf of the housing and provides an outward pressure against the latch to enable the connector plug to be coupled to a connector receptacle in a detachable manner; and an inline connector receptacle that includes, a housing including a top surface, side surfaces, and a bottom surface;

a pin contact assembly provided within the housing of the inline connector receptacle, wherein a cable attached to the pin contact assembly extends from a rear of the housing of the inline connector receptacle; and an opening provided on the top surface of the housing, the opening being disposed and sized so as to receive and hold in place the raised catch of the latch of the connector plug assembly when the connector plug assembly is detachably attached to the inline connector receptacle, wherein the housing further comprises an overhanging portion, wherein the latch includes a lip portion at one end of the latch, and wherein the latch is disposed on the top portion of the housing such that the lip portion of the latch is located underneath the overhanging portion of the housing, to thereby always maintain the lip portion of the latch underneath the overhanging portion of the housing to create a stop to the outward pressure provided to the latch by way of the elastomeric material.

11. An inline connector assembly, comprising:

a connector plug that includes, a housing that includes a top region, a bottom region, and a dividing shelf that divides the top region from the bottom region;

a latch that is disposed on a top portion of the housing, wherein the latch includes a top surface and a raised catch at one end of the top surface; and an elastomeric material that is provided beneath the latch, wherein the elastomeric material rests against a top surface of the dividing shelf of the housing and provides an outward pressure against the latch to enable the connector plug to be coupled to a connector receptacle in a detachable manner; and an inline connector receptacle that includes, a housing including a too surface, side surfaces, and a bottom surface;

a pin contact assembly provided within the housing of the inline connector receptacle, wherein a cable attached to the pin contact assembly extends from a rear of the housing of the inline connector receptacle; and an opening provided on the top surface of the housing, the opening being disposed and sized so as to receive and hold in place the raised catch of the latch of the connector plug assembly when the connector plug assembly is detachably attached to the inline connector receptacle, wherein the latch further comprises a cavity region provided on a bottom surface of the latch, the cavity region sized so as to accept a top portion of the elastomeric material when the elastomeric material and the latch are disposed within the housing.

12. An inline connector assembly, comprising:

a connector plug that includes, a housing that includes a top region, a bottom region, and a dividing shelf that divides the top region from the bottom region;

a latch that is disposed on a top portion of the housing, wherein the latch includes a top surface and a raised catch at one end of the top surface; and an elastomeric material that is provided beneath the latch, wherein the elastomeric material rests against a top surface of the dividing shelf of the housing and provides an outward pressure against the latch to enable the connector plug to be coupled to a connector receptacle in a detachable manner; and an inline connector receptacle that includes, a housing including a top surface, side surfaces, and a bottom surface;

a pin contact assembly provided within the housing of the inline connector receptacle, wherein a cable attached to the pin contact assembly extends from a rear of the housing of the inline connector receptacle; and an opening provided on the top surface of the housing, the opening being disposed and sized so as to receive and hold in place the raised catch of the latch of the connector plug assembly when the connector plug assembly is detachably attached to the inline connector receptacle, wherein the housing further comprises two fill holes provided on a bottom surface of the bottom region of the housing, wherein a filling material is inserted into the housing through at least one of the two fill holes, to thereby secure the pin contact assembly in place within the bottom region of the housing.

13. A connector plug, comprising:

a housing that includes a top region, a plurality of sidewalls, and a bottom region, wherein the top region includes an overhanging wall portion that extends inwards from one of the plurality of sidewalls of the housing to form an L shape;

a latch that is disposed on a top portion of the housing, wherein the latch includes a top surface, a raised catch disposed adjacent one end of the top surface, and a lip portion disposed between the one end of the top surface and the raised catch; and an elastomeric material that is provided beneath the latch, wherein the elastomeric material provides an outward pressure against the latch to enable the connector plug to be coupled to a connector receptacle in a detachable manner, and wherein the lip portion of the latch is disposed directly beneath the overhanging portion of the housing so as to provide limited up and down movement of the latch.

* * * * *